US006164809A

United States Patent [19]

Hawkins

[11] Patent Number: 6,164,809

[45] Date of Patent: Dec. 26, 2000

[54] COUNTER-FLOW ASPHALT PLANT WITH INDEPENDENTLY ROTATABLE DRYER AND MIXER

[76] Inventor: Michael R. Hawkins, 10735 NE. 112th St., Kansas City, Mo. 64157

[21] Appl. No.: 09/201,687

[22] Filed: Nov. 30, 1998

[51] Int. Cl.[7] ..... B28C 5/26

[52] U.S. Cl. ..... 366/7; 366/23; 366/25; 366/26; 366/62; 110/226; 432/103

[58] Field of Search ..... 366/4, 7, 14–15, 366/12, 22–26, 62; 110/224, 226; 432/103

[56] References Cited

U.S. PATENT DOCUMENTS

| | | | |
|---|---|---|---|
| 4,208,131 | 6/1980 | Mendenhall | 366/7 |
| 4,427,376 | 1/1984 | Etnyre et al. . | |
| 4,540,287 | 9/1985 | Servas et al. | 366/7 |
| 4,892,411 | 1/1990 | Elliot et al. | 366/25 |
| 4,913,552 | 4/1990 | Bracegirdle | 366/4 |
| 4,954,995 | 9/1990 | Marconnet | 366/7 |
| 5,201,839 | 4/1993 | Swisher, Jr. | 366/4 |

*Primary Examiner*—W. L. Walker
*Assistant Examiner*—Marianne S. Ocampo
*Attorney, Agent, or Firm*—Shook, Hardy & Bacon

[57] ABSTRACT

A counter-flow asphalt plant with a separately controlled and operated dryer 50 and mixer 52 in which virgin aggregate, recycle material and liquid asphalt are mixed to produce an asphaltic composition. The dryer 50 is rotated by a variable dryer drive 58 about a central longitudinal dryer axis disposed at a dryer angle of declination. Within the dryer 50, aggregates are dried and heated by heat radiation and a hot gas stream generated at a burner head 112 of a combustion assembly 106 positioned inside the downstream end of the dryer 50. The downstream end of the dryer 50 is inserted within the first end of the mixer 52 for delivery of the heated aggregate. The mixer 52 is carried on a tiltable frame 54 and is rotated by a variable mixer drive 88 about a central longitudinal mixer axis disposed at a mixer angle of declination. The dryer 50 and mixer 52 are arranged so that the longitudinal dryer axis and the longitudinal mixer axis lie in a common vertical plane where the mixer angle of declination may be adjustably varied to be less than, greater than or equal to the dryer angle of declination. A recycle feeder assembly 120 feeds recycle material to the mixer 52 between the discharge end of the dryer 50 and the first end of the mixer 52. Liquid asphalt is sprayed from an injector 104 and mineral fines are added from a conveyor 102 extended into the mixer 52. Accordingly, the recycle and liquid asphalt are isolated from the burner head 112 and hot gas stream within the dryer 50, and the mixing cycles and residence times of the materials in the dryer 50 and mixer 52 can be independently controlled to improve economy and efficiency of plant operations by adjustably varying the respective speeds of rotation of the dryer 50 and mixer 52 and by adjustably varying the respective angles of declination of the dryer and mixer.

26 Claims, 4 Drawing Sheets

COUNTER-FLOW ASPHALT PLANT WITH INDEPENDENTLY ROTATABLE DRYER AND MIXER

BACKGROUND OF THE INVENTION

This invention relates to a counter-flow asphalt plant used to produce a variety of asphalt compositions. More specifically, this invention relates to a counter-flow asphalt plant having independently controlled drying and mixing sections to vary material residence times and mixing cycles to improve economy and efficiency of plant operations.

Several techniques and numerous equipment arrangements for the preparation of asphaltic cement, also referred by the trade as "hotmix" or "HMA", are known from the prior art. Particularly relevant to the present invention is the continuous production of asphalt compositions in a drum mixer asphalt plant. Typically, water-laden virgin aggregates are dried and heated within a rotating, open-ended drum mixer through radiant, convective and conductive heat transfer from a stream of hot gases produced by a burner flame. As the heated virgin aggregate flows through the drum mixer, it is combined with liquid asphalt and mineral binder to produce an asphaltic composition as the desired end-product. Optionally, prior to mixing the virgin aggregate and liquid asphalt, reclaimed or recycled asphalt pavement (RAP) may be added once it is crushed up or ground to a suitable size. The RAP is typically mixed with the heated virgin aggregate in the drum mixer at a point prior to adding the liquid asphalt and mineral fines.

The asphalt industry has traditionally faced many environmental challenges. The drum mixer characteristically generates, as by-products, a gaseous hydrocarbon emission (known as blue smoke) and sticky dust particles covered with asphalt. Early asphalt plants exposed the liquid asphalt or RAP material to excessive temperatures within the drum mixer or put the materials in close proximity with the burner flame which caused serious product degradation. Health and safety hazards resulted from the substantial air pollution control problems due to the blue-smoke produced when hydrocarbon constituents in the asphalt are driven off and released into the atmosphere. The exhaust gases of the asphalt plant are fed to air pollution control equipment, typically a baghouse. Within the baghouse, the blue-smoke condenses on the filter bags and the asphalt-covered dust particles stick to and plug-up the filter bags, thereby presenting a serious fire hazard and reducing filter efficiency and useful life. Significant investments and efforts were previously made by the industry in attempting to control blue-smoke emissions attributed to hydrocarbon volatile gases and particulates from both the liquid asphalt and recycle material.

The earlier environmental problems were further exacerbated by the processing technique standard in the industry which required the asphalt ingredients with the drum mixer to flow in the same direction (i.e., co-current flow) as the hot gases for heating and drying the aggregate. Thus, the asphalt component of recycle material and liquid asphalt itself came in direct contact with the hot gas stream and, in some instances, even the burner flame itself.

For limited production, another common processing technique in the industry was known as a batch plant. Briefly, a batch-plant dryer included a rotating cylindrical drum in which aggregate was fed to an inlet end and heated by a hot gas stream flowing through the drum in a direction opposite the aggregate. The hot aggregate was expelled from the drum to a bucket conveyor which elevated the aggregate to a batch tower where it was mixed with liquid asphalt, dumped into a truck and carried to the job site. In addition to significant environmental concerns, batch plants suffered from low production rates, operating inefficiencies and product storage problems.

One prior art modification of the foregoing plant operation applied to a continuous process included a dryer elevated above a mixer for gravity feed thereto. However, this type system required a separate blue smoke fan to vent the mixer back to the burner for the dryer and also required the necessary ductwork for containment of the mixer gases. A very serious drawback, however, was the cooling effect in the mixer associated with the blue smoke fan.

Many of the earlier problems experienced by asphalt plants were solved with the development of modem day counter-flow technology as disclosed in my earlier patent Hawkins U.S. Pat. No. 4,787,938 which is incorporated herein by reference and which was first commercially introduced by Standard Havens, Inc. in 1986. The asphalt industry began to standardize on the counter-flow processing technique in which the ingredients of the asphaltic composition and the hot gas stream flow through a single, rotating drum mixer in opposite directions. Combustion equipment extends into the drum mixer to generate the hot gas stream at an intermediate point within the drum mixer. Accordingly, the drum mixer includes three zones. From the end of the drum where the virgin aggregate feeds, the three zones include a drying/heating zone to dry and heat virgin aggregate, a combustion zone to generate a hot gas stream for the drying/heating zone, and a mixing zone to mix hot aggregate, recycle material and liquid asphalt to produce an asphaltic composition for discharge from the lower end of the drum mixer.

Not only did the counter-flow process with its three zones vastly improve heat transfer characteristics, more importantly it provided a process in which the liquid asphalt and recycle material were isolated from the burner flame and the hot gas stream generated by the combustion equipment. Counter-flow operation represented a solution to the vexing problem of blue-smoke and all the health and safety hazards associated with blue-smoke.

A more complete understanding of the early equipment and processing techniques used by the asphalt industry can be found in the extensive listing of prior art patents and printed publications contained in my earlier patents Hawkins U.S. Pat. No. 5,364,182 issued Nov. 15, 1994, Hawkins U.S. Pat. No. 5,470,146 issued Nov. 28, 1995, and Hawkins U.S. Pat. No. 5,664,881 issued Sep. 9, 1997. Indeed, as a result of my first patent Hawkins U.S. Pat. No. 4,787,938 becoming involved in protracted litigation, the prior art collection cited in the foregoing patents is thought to be a thorough and exhaustive bibliographic listing of asphalt technology and such prior art is specifically incorporated herein by reference.

With many of the health and safety issues associated with asphalt production solved by the advent of counter-flow technology, attention has now shifted to operational inefficiencies which are manifest as product failing to conform to specifications and as excessive production costs.

During startup and shutdown operations, modem day counter-flow plants experience substantial product waste which affect operating costs. When a counter-flow plant is first started, one to two truckloads of material is wasted. This results from the larger stones in the initial charge of feed aggregate moving through the drum mixer more quickly than the rest of the aggregate. Consequently, the liquid asphalt cannot be added until all sizes of stones have reached the mixing zone.

When shutdown of the counter-flow plant is required, the entire drum mixer must be emptied. Because of the difficulty in precisely separating the uncoated aggregate from the coated aggregate, the remnant load in the mixing zone frequently fails to satisfy product specifications and must be scrapped. Uncoated aggregate can, of course, be reused during subsequent operations but the energy costs associated with the first drying and heating of the material are lost and the material must be re-handled.

The recycle feed assembly represents special concern during shutdown, even for brief periods of time and as experienced with overnight interruption of operations. Fed at an intermediate point in the drum mixer, the recycle material is normally introduced to a stationary collar which encircles the drum mixer. Blades on the drum itself stir through the recycle material contained by the collar and cause it to fall through openings in the drum. Any material which reaches the bottom of the recycle collar is trapped since it is below the level of the drum itself. Thus plugging causes numerous problems including abrasive wear on the drum shell during continuous operations. During shutdown periods, however, severe sticking often results as a result of plug buildup in the recycle collar.

The recycle assembly itself may add additional costs to the plant due to layout considerations. Conventional counter-flow recycle collars must have the inlet on the uphill rotation of the drum mixer. They also discharge finished product on the uphill side of the drum mixer. Layout considerations generally require the recycle feeder to be on the downhill rotational side of the drum. Therefore, the recycle conveyor must extend up and over the drum itself in order to feed the collar on the uphill side.

As a result of the size and weight of the equipment during normal processing conditions, the drive rollers which rotate the drum mixer are characteristically large and, therefore, expensive both initially and as a maintenance item.

Since the counter-flow process is carried out in a single rotating vessel, control techniques are necessarily limited. Basically the plant operator can control feed rates, the relative proportion of the materials such as aggregate, recycle, asphalt and binder, and the amount of heat energy introduced to the process by the combustion equipment. However, adjustments to such parameters typically must occur after the end-product is produced and analyzed. If the product is off-spec then changes in operating conditions must be made, and the output is analyzed once again to see if the product then meets specifications. Parameters such as temperatures intermediate the drum mixer, mixing cycles and residence times of component materials simply cannot be controlled in prior art counter-flow plants.

A need remains in the industry for improved counter-flow asphalt plant design and operating techniques to address the problems and drawbacks heretofore experienced with modem counter-flow production. The primary objective of this invention is to meet this need.

SUMMARY OF THE INVENTION

More specifically, an object of the invention is to provide a counter-flow asphalt plant having independently controlled drying and mixing sections to vary material residence times and mixing cycles to improve economy and efficiency of plant operations.

Another object of the invention is to provide a counter-flow asphalt plant having separate and independently controlled dryer and mixer wherein the dryer discharges directly to the mixer thereby eliminating the need for elevating the dryer or the need for intermediate material handling equipment, while at the same time minimizing heat loss during transfer of material. Such features improve overall plant layout and portability.

An additional object of the invention is to provide a counter-flow asphalt plant with separate dryer and mixer having a newly created process control parameter to independently vary the mixing cycle within the mixer relative to the mixing cycle within the dryer.

Yet another object of the invention is to provide a counter-flow asphalt plant with separate dryer and mixer having a newly created process control parameter to independently vary the material residence time in the mixer relative to the material residence time in the dryer.

A corollary object of the invention is to provide a counter-flow asphalt plant having separate and independently controlled dryer and mixer of the character described wherein the dryer and mixer may be rotated in opposite directions in order to meet plant layout logistics or to vary mixing cycle characteristics.

Another corollary object of the invention is to provide a counter-flow asphalt plant having separate and independently controlled dryer and mixer of the character described wherein the dryer and mixer may be rotated at different speeds in order to vary mixing action or material residence times.

Yet another corollary object of the invention is to provide a counter-flow asphalt plant having separate and independently controlled dryer and mixer of the character described wherein the mixer angle of declination may be adjustably varied to be less than, greater than or equal to the dryer angle of declination in order to vary mixing cycle characteristics or material residence times.

A further object of the invention is to provide a counter-flow asphalt plant of the character described having improved efficiency of operation and production consistency of finished product conforming to specifications.

An additional object of the invention is to provide a counter-flow asphalt plant of the character described having more precise control over operating parameters to achieve a uniform end-product and more precise control over energy requirements for improved economic operation.

A corollary of the foregoing object of the invention is to provide a counter-flow asphalt plant of the character described which eliminates wastage resulting from off-spec product heretofore experienced during plant startup.

Yet another corollary object of the invention is to provide a counter-flow asphalt plant of the character described which significantly minimizes both energy waste and the wastage of finished product and raw materials upon plant shutdown.

An added object of the invention is to provide a counter-flow asphalt plant of the character described which meets or exceeds modem day environmental standards by evacuation of blue-smoke from the mixer for delivery to the combustion zone within the dryer.

Another object of the invention is to provide a counter-flow asphalt plant with a separate dryer and drum mixer which may be used with recycle material and which effectively isolates the recycle material from the burner flame and hot gases.

A further object of the invention is to provide a counter-flow asphalt plant of the character described which is both safe and economical in operation. Efficient operation results in improved fuel consumption and in reduced air pollution emissions.

It is a still further object of the invention to provide a counter-flow asphalt plant of the type described which reduces the amount of hydrocarbons entrained in the hot gas stream and carried to the air pollution control equipment.

Other and further objects of the invention, together with the features of novelty appurtenant thereto, will appear in the detailed description of the drawings.

In summary, a counter-flow asphalt plant with a separately controlled and operated dryer and mixer in which virgin aggregate, recycle material and liquid asphalt are mixed to produce an asphaltic composition. The dryer is rotated by a variable dryer drive about a central longitudinal dryer axis disposed at a dryer angle of declination. Within the dryer, aggregates are dried and heated by heat radiation and a hot gas stream generated at a burner head of a combustion assembly positioned inside the downstream end of the dryer. The downstream end of the dryer is inserted within the first end of the mixer for delivery of the heated aggregate. The mixer is carried on a tiltable frame and is rotated by a variable mixer drive about a central longitudinal mixer axis disposed at a mixer angle of declination. The dryer and mixer are arranged so that the mixer angle of declination may be adjustably varied to be less than, greater than or equal to the dryer angle of declination. A recycle feeder assembly feeds recycle material to the mixer between the discharge end of the dryer and the first end of the mixer. Liquid asphalt is sprayed from an injector and mineral fines are added from a conveyor extended into the mixer. Accordingly, the recycle and liquid asphalt are isolated from the burner head and hot gas stream within the dryer, and the mixing cycles and residence times of the materials in the dryer and mixer can be independently controlled to improve economy and efficiency of plant operations by adjustably varying the respective speeds of rotation of the dryer and mixer and by adjustably varying the respective angles of declination of the dryer and mixer.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
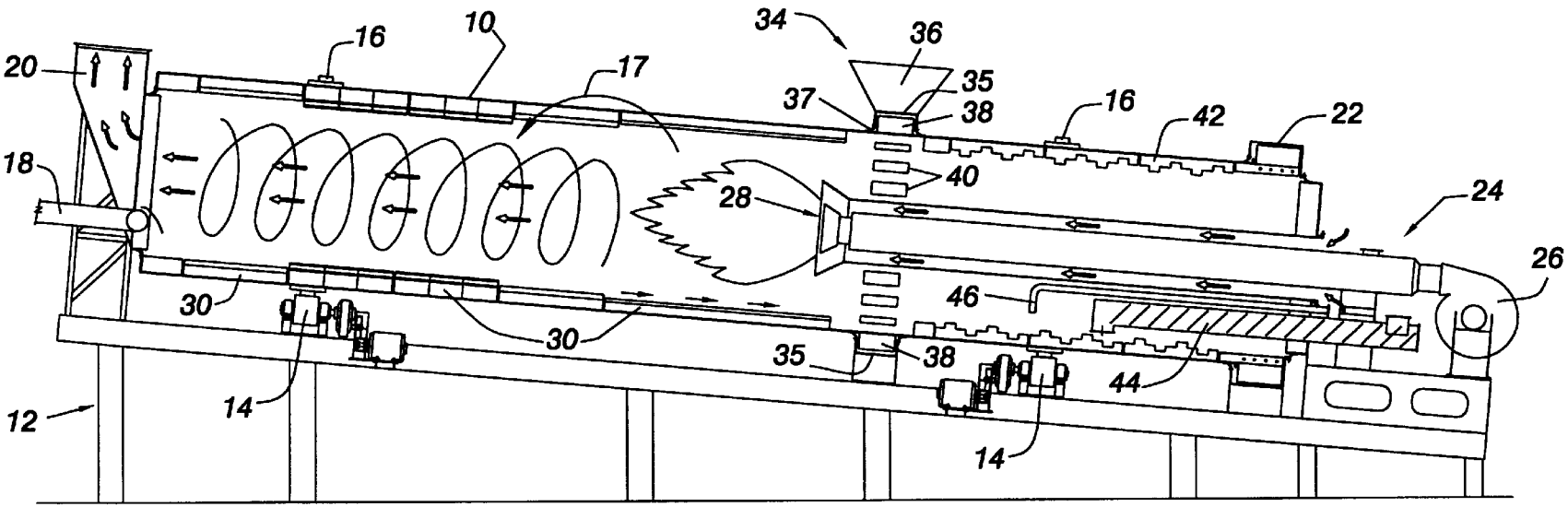
Fig.1 PRIOR ART
FIG. 1 is a side sectional view of a prior art counter-flow asphalt plant in order to compare and contrast the teachings of this invention.

Referring now to the drawings in greater detail, attention is first directed a modem day counter-flow asphalt plant as shown in the prior art illustration of FIG. 1 for the purpose of subsequently comparing and contrasting the structure and operation of an asphalt plant constructed in accordance with this invention as illustrated in FIGS. 2–11. The prior art asphalt plant of FIG. 1 is shown and described in greater detail in Hawkins U.S. Pat. No. 4,787,938 incorporated herein by reference.

The prior art counter-flow plant includes a substantially horizontal, single drum mixer 10 carried by a ground engaging support frame 12 at a slight angle of declination, typically about 5 degrees. Mounted on the frame 12 are two pairs of large, motor driven rollers 14 which supportingly receive trunnion rings 16 secured to the exterior surface of the drum mixer 10. Thus, rotation of the drive rollers 14 engaging the trunnion rings 16 causes the drum mixer 10 to be rotated about its central longitudinal axis in the direction of the rotational arrow 17.

Located at the inlet or upstream end of the drum mixer 10 is an aggregate feeder 18 to deliver aggregate to the interior of the drum mixer 10 from a storage hopper or stockpile (not shown). The inlet end of the drum mixer 10 is closed by a flanged exhaust port 20 leading to conventional air pollution control equipment (not shown), such as a baghouse, to remove particulates from the gas stream.

Located at the outlet end of the drum mixer 10 is a discharge housing 22 to direct asphaltic composition from the drum mixer 10 to a material conveyor (not shown) for delivery of the final product to a storage bin or transporting vehicle.

A combustion assembly 24 extends through the discharge housing 22 and into the drum mixer 10 to deliver fuel, primary air from a blower 26 and induced secondary air through an open annulus to a burner head 28. Combustion at the burner head 28 generates a hot gas stream which flows through the drying zone of the drum mixer 10. Within the drying zone are fixed various types of flights or paddles 30 for the alternative purposes of lifting, tumbling, mixing, and moving aggregate within the drum mixer 10 to facilitate the drying and heating of the aggregate therein.

Downstream of the burner head 28 is located the recycle feed assembly 34 by which recycle asphalt material may be introduced into the drum mixer 10. A stationary box channel 35 encircles the exterior surface of the drum mixer 10 and includes a feed hopper 36 providing access to the interior of the box channel 35. Bolted to the side walls of the box channel 35 are flexible seals 37 to permit rotation of the drum mixer 10 within the encircling box channel 35. Secured to the outer wall of the drum mixer 10 and projecting into the space defined by the box channel 35 are a plurality of scoops 38 radially spaced around the drum mixer 10. At the bottom of each scoop 38 is a scoop opening 40 through the wall of the drum mixer 10 to provide access to the interior of drum mixer 10. Thus, recycle asphalt material may be delivered by conveyor (not shown) through the feed hopper 36, into the box channel 35 and subsequently introduced into the interior of the drum mixer 10 through the scoop openings 40.

Downstream of the recycle feed assembly 34 is a mixing zone within the drum mixer 10. Mounted on the interior thereof are staggered rows of sawtooth flighting 42 to mix and stir material within the annulus of the drum mixer 10 and combustion assembly 24. A conveyor 44 extends into the drum mixer 10 for feeding binder material or mineral "fines" to the mixing zone. Likewise extending into the drum mixer 10 is an injection tube 46 for spraying liquid asphalt into the mixing zone. At the end of the mixing zone is located the discharge housing 22 as previously discussed through which the asphaltic product is discharged.

With the foregoing background in mind, attention is now directed to the counter-flow asphalt plant constructed in accordance with a preferred embodiment of this invention as illustrated in FIGS. 2–7 & 10. As an overview, it will be noted that the asphalt plant comprises two separate cylinders—a dryer cylinder 50 and a mixer cylinder 52—instead of a single cylinder as is the standard construction of a modem day counter-flow plant. Both the dryer cylinder 50 and the mixer cylinder 52 are supported on a support frame 54 to variably control the mixer angle of declination with respect to the dryer angle of declination as will become apparent in the detailed description of the invention which follows.

The dryer cylinder 50 is carried at a dryer angle of declination on a fixed end of the support frame 54. The frame 54 comprises spaced apart, parallel beams 56 declined from a level horizontal orientation and supported by ground engaging vertical legs 57. Mounted on the parallel beams 56 are two pairs of variable, dryer drive rollers 58 which supportingly receive trunnion rings 60 secured to the exterior surface of the dryer cylinder 50. Thus, rotation of the drive rollers 58 engaging the trunnion rings 60 causes the dryer cylinder 50 to be rotated at a preselected speed about the central longitudinal dryer axis.

Located at the inlet or upstream end of the dryer cylinder 50 is an aggregate feeder 62 to deliver aggregate to the interior of the dryer cylinder 50 from a storage hopper or stockpile (not shown). The inlet end of the dryer cylinder 50 is closed by a flanged exhaust port 64 having a flexible seal 66 to permit rotation of the dryer cylinder 50. The exhaust port 64 is connected to conventional air pollution control equipment (not shown), such as a baghouse, to remove particulates from the gas stream.

At different regions throughout the interior of the dryer 50 are fixed various types of flightings or paddles for the alternative purposes of lifting, tumbling, mixing, guiding, stirring and moving the material contained within the dryer 50. The actions of the various flightings are known to those skilled in the art and, accordingly, the flightings now disclosed are intended as workable embodiments but are not exhaustive of the various combinations which could be utilized with the invention.

At the inlet end of the dryer cylinder 50, slanted guide paddles 68 are fixed to the interior of the cylinder to direct material from the aggregate feeder 62 inwardly to bucket flighting 70. The bucket flighting 70 is typically arranged in longitudinal rows with the longitudinal axis of the dryer 50. So configured and arranged, when the dryer 50 is rotated, aggregate material in the bottom of the dryer cylinder 50 will be picked up by the bucket flighting 70. As the bucket flighting 70 rotates upwardly, material begins to fall off the flighting to create a curtain of falling aggregate within the dryer.

Downstream of the bucket flighting 70, low-profile combustion flighting 72 is mounted interiorly of the dryer cylinder 50 to carry aggregates around the inner surface as the dryer cylinder 50 rotates, without creating a falling curtain of material as is the case with the bucket flighting 70. This action prevents direct contact of the aggregate with the flame of the combustion head as to be later described.

At the end of the combustion flighting 72, slanted elevator and discharge plates 74 are fixed to the interior surface of a frusto-conical section 76 and the discharge mouth section 78 formed at the downstream end of the dryer cylinder 50. Rotation of the dryer 50 causes aggregate to travel up the frusto-conical section 76 and over the discharge mouth 78 to be fed interiorly of the mixer cylinder 52 as indicated by the flow arrows. In other words, the discharge end of the dryer 50 must extend into the upper end of the mixer 52 to insure proper delivery of the aggregate thereto. A temperature sensor thermocouple 80 is mounted within the mixer cylinder 52 adjacent the discharge mouth 78 of the dryer 50 to sense the temperature of aggregate material discharged from the dryer 50.

The mixer cylinder 52 is carried at a mixer angle of declination on a tiltable end of the support frame 54 which includes a pivot axle 82 which pins the fixed end of the frame to the tiltable end of the frame. The tiltable end of the frame 54 comprises spaced apart, parallel beams 84 declined from a level horizontal orientation. The tiltable end is supported from the fixed end of the frame at the pivot axle 82 and from a height adjustable jack 86. The jack 86 may by mechanically, pneumatically or hydraulically controlled and actuated to extend or retract in order to decrease or increase the mixer angle of declination.

Mounted on the parallel beams 84 are two pairs of variable, mixer drive rollers 88 which supportingly receive trunnion rings 90 secured to the exterior surface of the mixer cylinder 52. Thus, rotation of the drive rollers 88 engaging the trunnion rings 90 causes the mixer cylinder 52 to be rotated at a preselected, but variable speed about the central longitudinal mixer axis. It is particularly important to this invention that the mixer drive rollers 88 be independently controlled and be adapted to rotate the mixer 52 about the mixer longitudinal axis at a speed less than, greater than or equal to the speed of rotation of the dryer 50 about the dryer longitudinal axis by the dryer drive rollers 58. Moreover, the mixer drive rollers 88 may even be optionally adapted to rotate the mixer 52 about the mixer longitudinal axis in a direction opposite the direction of rotation of the dryer 50 about the dryer longitudinal axis.

The support frame 54 as illustrated in the drawings is articulated. It will be understood that a broad range of support configurations for the dryer cylinder 50 and mixer cylinder 52 may be used in place of an articulated frame. For example, the fixed end and tiltable end of the support frame 54 may be separated as will be readily understood by those skilled in the art. Regardless of the support structure utilized, however, the position and orientation of the mixer 52 relative to the dryer 50 is critically important to the objectives of this invention. Accordingly, additional explanation of such relationship may be helpful.

As previously mentioned, the discharge mouth 78 of the dryer 50, at least at the actual region of material discharge, must fit within the first end of the mixer 52 in order to properly receive aggregate material from the dryer 50. This relationship necessarily requires that the first end of the mixer 52 be larger in diameter that the discharge mouth 78 of the dryer 50. Accordingly, the projection of the cross sectional area of the discharge mouth 78 of the dryer 50 is contained within the larger, cross sectional area of the end first of the mixer 52.

When the dryer 50 and mixer 52 are concentrically aligned as generally illustrated in the embodiment of FIGS. 2–7 & 10, then the longitudinal mixer axis, when viewed from above as in a plan view, aligns with the longitudinal dryer axis at all times. That is to say that the longitudinal mixer axis and longitudinal dryer axis lie in the same vertical plane even though the invention specifically contemplates that the respective angles of declination of the dryer 50 and mixer 52 may differ at times during operation of the asphalt plant.

Furthermore, when the dryer 50 and mixer 52 are concentrically aligned, the angle of declination of the longitudinal dryer axis will intersect the angle of declination of the longitudinal mixer axis during such times as the angle of declination of the longitudinal dryer axis differs from the angle of declination of the longitudinal mixer axis. Such intersection of the dryer axis and mixer axis will necessarily lie within the common vertical plane of these axes. Such intersection of the dryer and mixer axes also falls within the region defined by the combined interior spaces of the dryer 50 and mixer 52. On the other hand, when the dryer 50 and mixer 52 are oriented at the same angle of declination, then the longitudinal mixer axis will coincide with the longitudinal dryer axis, again assuming the dryer 50 and mixer 52 are concentrically aligned.

In the observance of the foregoing relationship of the dryer 50 and mixer 52, the jack 86 may be adjusted to vary the mixer angle of declination, either plus or minus, from 0 to 3 degrees from the dryer angle of declination. In terms of absolute rather than relative values, a workable range for the dryer angle of declination is from 2.5 to 6.5 degrees with a corresponding range for the mixer angle of declination of 1 to 8 degrees. A typical standard in the asphalt industry for a conventional counter-flow (i.e., a single drum cylinder) plant is a declination of approximately 5 degrees. Accordingly, at least one preferred orientation of the present invention includes a dryer angle of declination of approximately 5 degrees and a mixer angle of declination in the range of 1 to 6 degrees.

Figure 2:
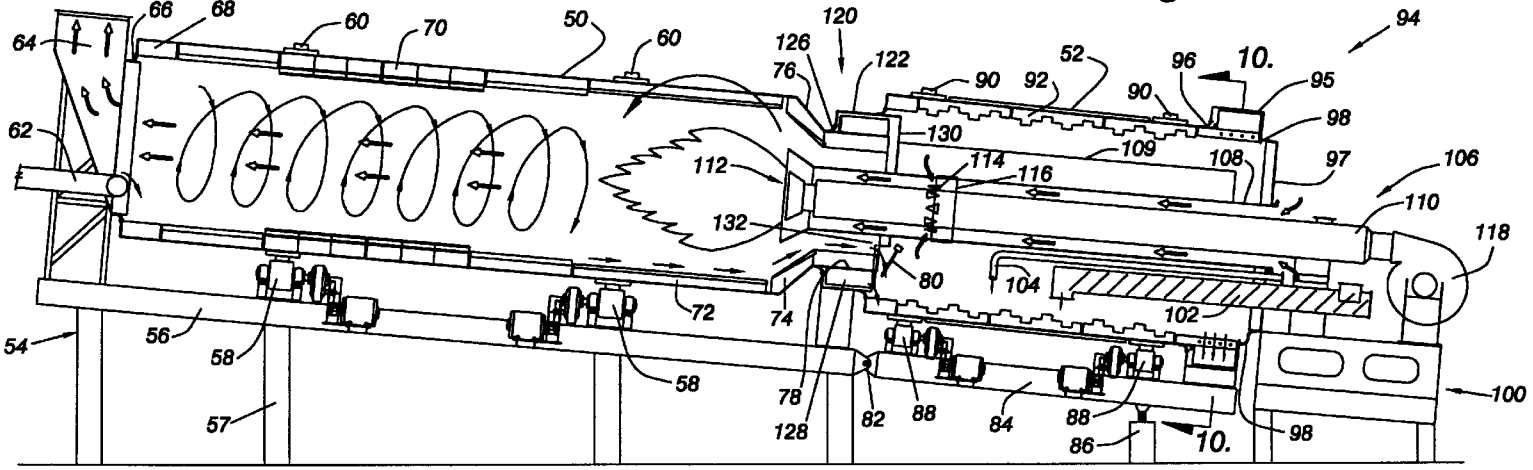
FIG. 2 is a side sectional view of a counter-flow asphalt plant constructed in accordance with a preferred embodiment of the invention, and shown with the mixer declined at an angle greater than the angle of declination of the dryer.
Figure 3:
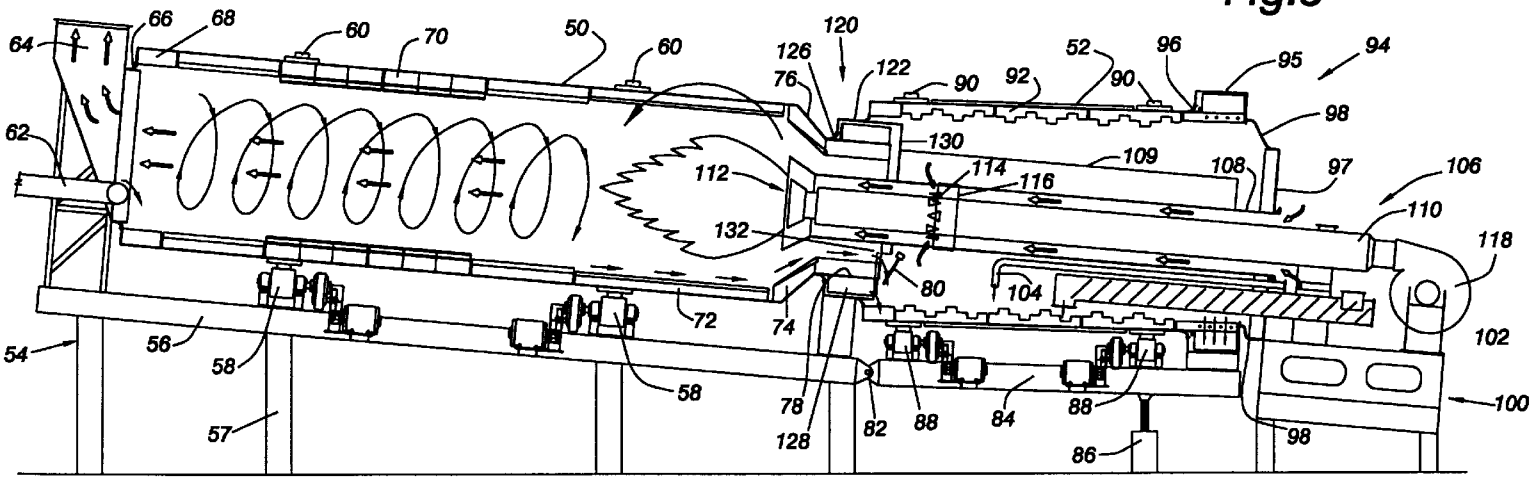
FIG. 3 is a side sectional view of a counter-flow asphalt plant similar to FIG. 2, but shown with the mixer declined at an angle less than the angle of declination of the dryer.
Figure 7:
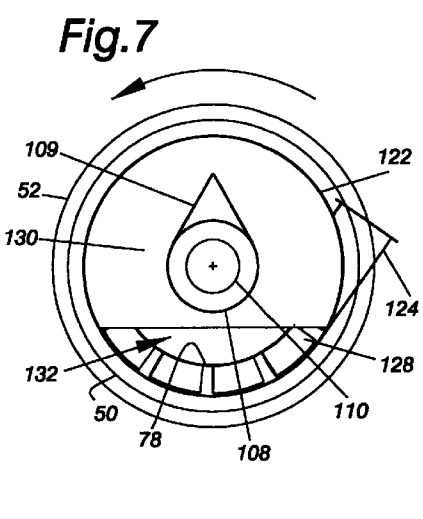
FIG. 7 is a sectional view taken through the recycle feed assembly along line 7—7 of FIG. 4 in the direction of the arrows.
Figure 6:
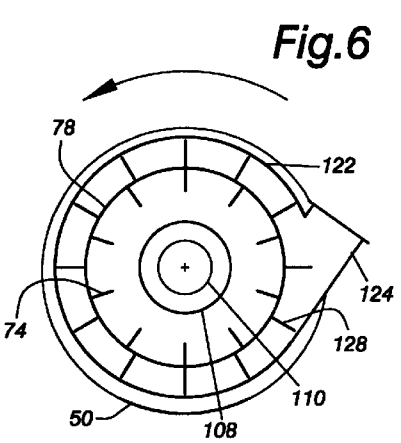
FIG. 6 is a sectional view taken through the recycle feed assembly along line 6—6 of FIG. 4 in the direction of the arrows.
Figure 4:
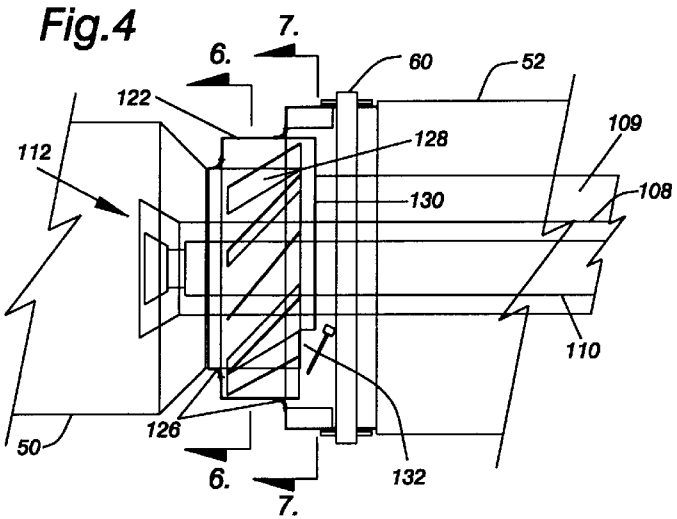
FIG. 4 is a fragmentary, enlarged side sectional view of the recycle feed assembly of the asphalt plant.
Figure 10:
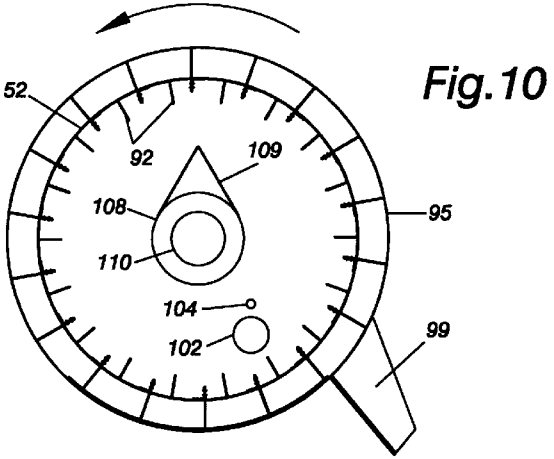
FIG. 10 is an enlarged sectional view of the product discharge assembly along line 10—10 of FIG. 2 in the direction of the arrows.

As visual illustration of the relationship, comparison may be made of FIGS. 2 & 3. In FIG. 2, the mixer cylinder 52 is declined at an angle greater than the angle of declination of the dryer cylinder 50. Specifically, the dryer angle of declination is approximately 5 degrees and the mixer angle of declination is approximately 6 degrees. In FIG. 3, on the other hand, the mixer 52 is declined at an angle less than the angle of declination of the dryer 50. Specifically, the dryer angle of declination is approximately 5 degrees and the mixer angle of declination is approximately 2 degrees.

Around the interior surface of the mixer cylinder 52 are staggered rows of sawtooth flighting 92. The sawtooth flighting 92 has irregular step-type edge surfaces to mix and stir material within the mixer 52 and to move the material to a discharge assembly 94 at the downstream end of the mixer 52. The discharge assembly 94 includes a non-rotating discharge collar 95 to receive the outlet end of the mixer cylinder 52 and a bearing seal 96 bolted to the wall of the collar 95 to permit rotation of the mixer 52. The discharge assembly also includes a stationary end plate 97 vertically positioned at the end of the mixer 52. The end plate 97 is connected to the discharge collar 95 by a sealing skirt 98 to close the end of the mixer 52. The skirt 98 also permits the discharge collar 95 to be vertically shifted relative to the end plate 97. Such relationship can be better understood by comparing FIGS. 2 & 3. The lower portion of the discharge collar 95 is connected to a funnel or discharge mouth 99 to direct asphaltic composition from the mixer 52 to a material conveyor (not shown) for delivery of the product to a storage bin or transporting vehicle.

Separately spaced apart from the discharge end of the mixer 52 is a ground engaging support pad 100. A conveyor 102 supportingly mounts to the pad 100 and sealingly penetrates the end plate 97 of the discharge assembly 94 to extend into the mixer 52. The conveyor 102 is connected to conventional equipment (not shown) for feeding binder material or mineral "fines" to the mixer 52. As an alternative to the conveyor 102, mineral additives may be delivered to the mixer 52 through a pneumatic line.

An asphalt injection tube 104 supportingly mounts to the pad 100 and sealingly penetrates the end plate 97 of the discharge assembly 94 to extend into the mixer 52. The asphalt injection tube 104 is connected to conventional equipment (not shown) for spraying liquid asphalt in the mixer 52.

Also mounted on the support pad is a combustion assembly 106 which extends through the end plate 97 of the discharge assembly 94, through the mixer 52, and into the dryer 50. The longitudinal axis of the combustion assembly 106 generally coincides with the longitudinal axis of the dryer 50 but will not necessarily coincide with the longitudinal axis of the mixer 52 (i.e., it will only coincide when the axes of the dryer and mixer themselves coincide). The combustion assembly 106 includes an elongate secondary air tube 108 which at one end thereof extends through the end plate 97 to establish atmospheric communication. A tepee shield plate 109 is secured atop the secondary air tube 108 to deflect any process material dropped from above during the mixing process. Received within the secondary air tube 108 is a primary air tube 110 having a burner head 112 at the innermost end thereof. Within the primary tube 110 is a fuel delivery line (not shown) conventional to such equipment for the delivery of fuel to the burner head 112. The primary tube 110 is of smaller diameter than the secondary air tube 108 to form an annulus 112 therewith in which secondary air is drawn from the outside, as indicated by the arrows, to support combustion at the burner head 112. The secondary air tube 108 includes a plurality of holes 114 therethrough at a position along its length that lies within the mixer 52. A slidable damper sleeve 116 encircles the secondary air tube 108 and may be adjustably positioned thereon to cover more or less of the holes 114 in order to regulate smoke evacuation from the mixer 52 through the annulus 112 to the burner head 112. Fitted to the opposite end of the primary tube 110 is a blower 118 to force blower air through the primary tube 110 to the burner head 112. As the primary blower air is discharged from the burner head 112, it atomizes fuel to maintain a burner flame directed longitudinally into the dryer as illustrated.

Downstream of the end of the burner head 112 is located a recycle feed assembly 120 by which recycle asphalt material may be introduced into the mixer 52 through the annulus represented by the inside diameter of the mixer 52 and the outside diameter of the discharge mouth 78 of the dryer 50. As shown in the embodiment illustrated in FIGS. 4–7, the recycle feed assembly includes a stationary box collar 122 which encircles the exterior surface of the discharge ring or mouth 78 of the dryer 50, and a feed hopper 124 providing access to the interior of the box collar 122. Bolted to the side walls of the box collar 122 is a flexible seal 126 to permit rotation of the dryer 50 within the encircling box collar 122. Secured to the outer wall of the discharge ring 78 and projecting into the space defined by the box collar 122 are a plurality of radially spaced paddles 128 which rotate with the dryer 50. On its downstream edge, the collar 122 is attached to a wall 130 penetrated by the combustion assembly 106. An opening 132 is formed in the lower portion of the wall 130 to provide access to the inside of mixer 52. Thus, recycle asphalt material may be delivered by conveyor (not shown) to the feed hopper 124 attached to the box collar 122 and subsequently introduced into the interior of the mixer 52. Operation in this manner permits the introduction of the recycle asphalt without exposure to the hot gas stream generated at the burner head 112 for the reasons previously taught in Hawkins U.S. Pat. No. 4,787,938.

Figure 5:
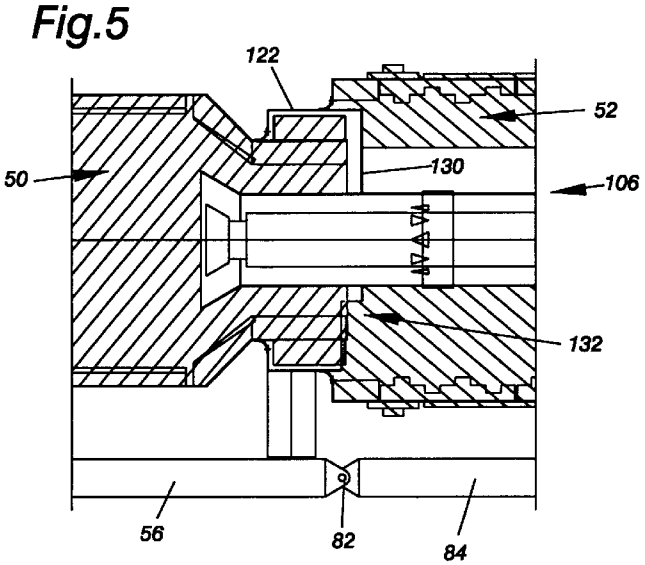
FIG. 5 is an enlarged side sectional view of the recycle feed assembly of the asphalt plant similar to FIG. 4 but with special 45° hatching to identify the rotating structure of the dryer cylinder and 135° hatching to identify the rotating structure of the mixer cylinder, and to distinguish such rotating structures from the stationary structure of the recycle feed and combustion assemblies.

Special reference is made to FIG. 5. Contrary to normal convention, the hatching is NOT intended to show cross section. Rather, FIG. 5 is included to clarify the rotating versus non-rotating structure adjacent the recycle feed assembly 120. The special 45° hatching identifies that structure which rotates with the dryer 50. Conversely, the 135° hatching identifies that structure which rotates with the mixer 52. The structure shown in solid lines in FIG. 5, such as portions of the recycle feed assembly 120, combustion assembly 106 and support frame 54, depict features which are stationary.

Figure 9:
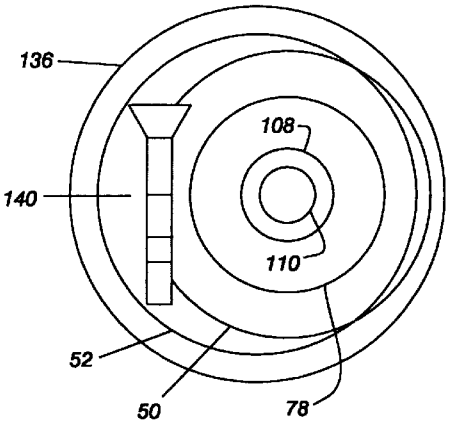
FIG. 9 is a sectional view of the recycle feed assembly taken along line 9—9 of FIG. 8 in the direction of the arrows.
Figure 8:
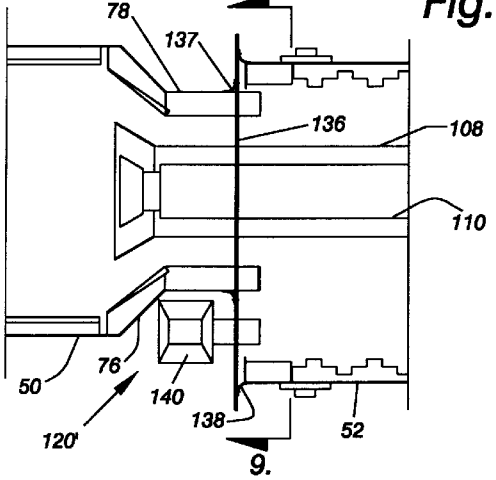
FIG. 8 is a fragmentary, enlarged top plan view of an alternative embodiment of a recycle feed assembly of the asphalt plant.

Attention is next directed to the alternative recycle feed assembly 120' illustrated in FIGS. 8–9 of the drawings for the purposes of discussing two different and unrelated teachings of my disclosure. As previously described, recycle asphalt material is to be introduced into the mixer 52 between the inside diameter of the mixer 52 and the outside diameter of the discharge mouth 78 of the dryer 50. A stationary wall 136 is secured from the support frame (not shown) to overlie the end of the mixer 52 and to receive the discharge end 78 of the dryer 50. A flexible seal 137 is secured to the wall 136 to form a friction seal with the dryer cylinder 50 which permits rotation of the dryer 50 with its discharge mouth penetrating the central opening of the wall 136. A second flexible seal 138 is secured to the wall 136 to form a friction seal with the mixer cylinder 52 which permits rotation of the mixer 52. A feed chute 140 sealingly penetrates the wall 136 and extends through the space between the mixer 52 and dryer 50 to deliver recycle material to the interior of the mixer 52. As in the prior arrangement disclosed, recycle asphalt is introduced into the mixer 52 and is isolated from exposure to the hot gas stream generated at the burner head 112.

FIGS. 8–9 of the drawings additionally illustrate an alternative position and orientation of the mixer 52 relative to the dryer 50 in which the equipment is NOT concentrically aligned. Rather, the dryer 50 and mixer 52 are offset. They may be offset in either a vertical or horizontal plane. In the illustration of FIGS. 8–9, the dryer 50 and mixer 52 have their respectively axes of rotation offset horizontally. In conformance with the prior teachings of this invention, the arrangement illustrated in FIGS. 8–9 shows the discharge mouth 78 of the dryer 50 fitting within the first end of the mixer 52 in order to properly receive aggregate material from the dryer 50. This relationship necessarily requires that the first end of the mixer 52 be larger in diameter that the discharge mouth 78 of the dryer 50. Accordingly, the projection of the cross sectional area of the discharge mouth 78 of the dryer 50 is contained within the larger, cross sectional area of the end first of the mixer 52.

In the observance of the foregoing relationship of the dryer 50 and mixer 52, the mixer 52 may be adjusted to vary the mixer angle of declination, either plus or minus, from 0 to 3 degrees from the dryer angle of declination. In terms of absolute rather than relative values, a workable range for the dryer angle of declination is from 2.5 to 6.5 degrees with a corresponding range for the mixer angle of declination of 1 to 8 degrees. A typical standard in the asphalt industry for a conventional counter-flow (i.e., a single drum cylinder) plant is a declination of approximately 5 degrees. Accordingly, at least one preferred orientation of the present invention includes a dryer angle of declination of approximately 5 degrees and a mixer angle of declination in the range of 1 to 6 degrees.

In the asphalt plant as illustrated in the embodiments of FIGS. 2–10, the dryer 50 is shown and described with a necked down discharge mouth 78 of reduced diameter from the major length of the dryer cylinder. The purpose of such design and construction is to minimize the diameter of the mixer 52 into which the discharge end of the dryer 50 must be inserted. Modern production capacities require that the equipment be rather large. By way of example only, and without limitation on the principles taught by this invention, the dryer 50 illustrated can have a diameter of about 9'–6" necked down to a discharge mouth 78 of about 6'–6" received in a mixer 52 with a diameter of about 10'–6". In such configuration, the recycle collar 122 can have a diameter of about 7'–6" in order to provide an annulus of approximately 6" through which recycle material may be delivered to the mixer 52.

Figure 11:
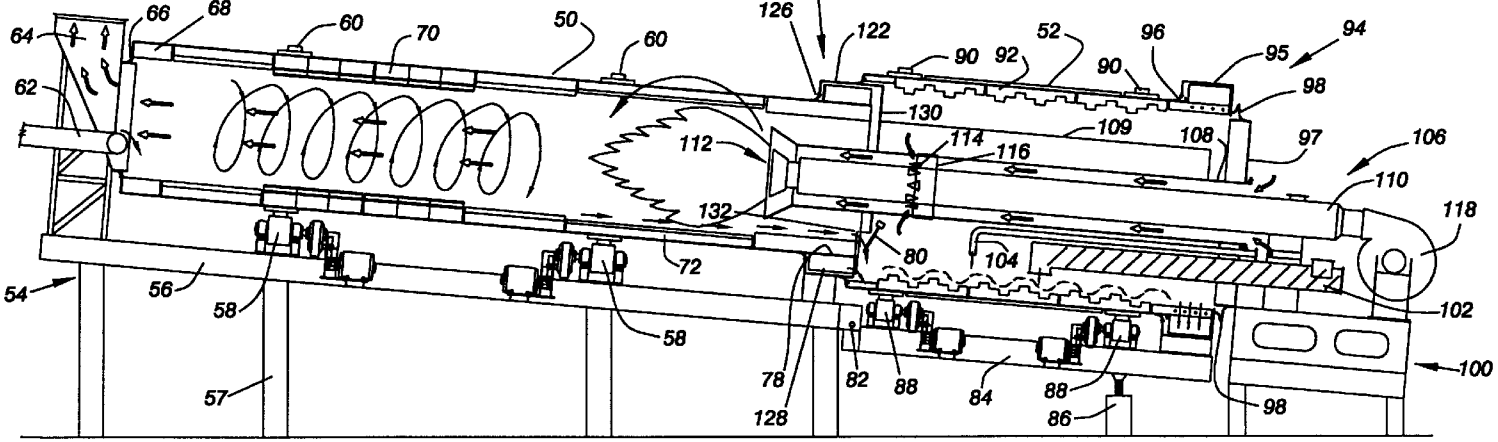
FIG. 11 is a side sectional view of a counter-flow asphalt plant constructed in accordance with an alternative embodiment of the invention with the dryer having a uniform diameter throughout its length.

An alternate embodiment of the invention is shown in FIG. 11 in which the dryer 50' has a uniform diameter throughout its length. Equipment and parts illustrated in FIG. 11 similar to those parts and equipment previously described with reference to the embodiment of FIGS. 2–10 have been identified with the same numerals for the purpose of brevity and the previous descriptions are equally applicable to FIG. 11.

In operation, the flow of asphaltic composition ingredients and hot gas stream within the counter-flow plant of this invention is generally analogous to the flow of the same materials in any conventional counter-flow drum mixer. However, separation of the dryer 50 and mixer 52 in a counter-flow plant as taught herein affords some distinct advantages by providing control parameters heretofore unavailable in asphalt plants. Accordingly, different operating procedures are now available to accomplish the objectives of this invention as previously set forth.

Plant startup is staged. First, rotation of the mixer 52 is delayed from the start of rotation of the dryer 50. The time of delay may be varied. Generally, when heated aggregate begins to accumulate in the mixer 52, then rotation of the mixer 52 is started as soon as a representative samples of all sizes of stones are present. Liquid asphalt injection is controlled by a separate timing function and may begin just prior to, or just after, rotation of the mixer 52 commences. The important operational feature is that material is allowed to accumulate, holding back the initial sparse flow until full material flow has reached the mixer 52. Liquid asphalt is then added through the injector 104 , and as the mixing cycle for the ingredients is completed, a homogeneous finished product conforming to specifications is produced and discharged through chute 99.

Likewise, plant shutdown is staged which is completely different from operation of a conventional counter-flow plant. First, rotation of the dryer 50 is halted and injection of liquid asphalt to the mixer 52 is stopped. The mixer 52, however, continues to rotate. This action completes the mixing cycle for the asphaltic constituents present in the mixer 52 and specification conforming product is discharged to completely empty the mixer 52 and is conveyed to the storage silo. As in the case of plant startup, virtually no material is wasted on shutdown. With a conventional counter-flow plant, on the other hand, the entire drum mixer must be left loaded when shutdown for a short period, or must be completely emptied which results in substantial wastage of materials and energy costs.

Operational control of the asphalt plant disclosed in this invention is significantly different from the conventional counter-flow plant. First, heat energy requirements to the process are more effectively monitored to permit early intervention if adjustments are necessary. Monitoring is achieved by the thermocouple 80 measuring the discharge temperature of the heated aggregate directly from the dryer. This was not previously possible in a conventional plant and temperature measurements had to be taken at the discharge of the mixing zone, after the heated aggregate had transferred some of its heat energy to the recycle material, liquid asphalt and mineral additives.

Second, control of the rotational speed of the mixer 52 relative to the dryer 50 has not been previously possible in a counter-flow plant. Third, control of the angle of declination of the mixer 52 relative to the dryer 50 also has not been previously possible in a counter-flow plant. Both are important control parameters in the new breed of counter-flow technology now disclosed.

At a preselected angle of declination, increasing the rotational speed of the mixer 52 decreases the residence time of the material being mixed. On the other hand, decreasing the rotational speed of the mixer 52 increases the residence time of the material being mixed. The speed of rotation of the mixer 52 does not, however, influence the mixing cycle itself—that is, the number of mixer rotations for material to move from one end of the mixer to the other.

At a preselected speed of rotation, increasing the angle of declination of the mixer 52 relative to the dryer 50 decreases both the residence time of the material being mixed and the mixing cycle. This provides a less thorough and deliberate mixing action to be carried out. On the other hand, decreasing the angle of declination of the mixer 52 relative to the dryer 50 increases both the residence time of the material being mixed and the mixing cycle. This provides a more thorough and deliberate mixing action to be carried out.

As those skilled in the asphalt art will readily understand, there are a number of circumstances in which a plant operator might benefit from the ability to control a counter-flow plant in the foregoing manner. A few examples of such circumstances, without limitation to the teachings of this invention, may be helpful. Normally, asphaltic compositions having recycle material as a component will benefit from increased mixing time versus asphaltic compositions formulated only from virgin materials. Also, recycle mixes of larger particle sizes usually require more residence mix time than recycle mixes having smaller particles. Specialty mixes that are easily oxidized, such as those containing polymers or high volatile organic compounds (VOCs) typically benefit from reduced mixing cycles. On the other hand, hard to coat materials such as large porous rock normally benefit from increased mixing cycles.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A counter-flow asphalt plant for producing an asphaltic composition from asphalt and aggregates, said asphalt plant comprising:

a dryer cylinder rotatable about a central longitudinal dryer axis thereof and having a first end and a second cylindrical end with an internal passageway communicating there between, said dryer cylinder being disposed with its central longitudinal dryer axis at a dryer angle of declination such that said first end is positioned slightly above said second cylindrical end;

an aggregate feeder having a discharge mouth extending within said first end of said dryer cylinder to deliver aggregate material to the internal passageway of said dryer cylinder;

a motorized dryer drive to rotate said dryer cylinder about the central longitudinal dryer axis to cause material therein to move from said first end to said second cylindrical end of said dryer cylinder;

a mixer cylinder rotatable about a central longitudinal mixer axis thereof and having a first cylindrical end and a second end with an internal passageway communicating there between, said mixer cylinder being disposed with its central longitudinal mixer axis at a mixer angle of declination such that said first cylindrical end is positioned slightly above said second end, said mixer cylinder being positioned with respect to said dryer cylinder such that said second cylindrical end of said dryer cylinder is disposed within said first cylindrical end of said mixer cylinder to receive aggregate material discharged from said dryer cylinder;

a motorized mixer drive to rotate said mixer cylinder about the central longitudinal mixer axis to cause material therein to move from said first cylindrical end to said second end of said mixer cylinder;

a combustion burner head positioned interiorly of said dryer cylinder adjacent said second cylindrical end thereof to generate a hot gas stream to flow in a countercurrent direction to the flow of aggregate material within said dryer cylinder in order to heat and dry the aggregate material within said dryer cylinder;

a liquid asphalt feeder disposed within said mixer cylinder for delivering liquid asphalt thereto to form an asphaltic composition; and a discharge port connected to said second end of said mixer cylinder for discharging said asphaltic composition from said mixer cylinder.

2. The asphalt plant as set forth in claim 1, including a mixer declination angle adjustment device to adjustably vary said mixer angle of declination relative to said dryer angle of declination.

3. The asphalt plant as set forth in claim 2, said mixer declination angle adjustment device being adapted to adjustably vary said mixer angle of declination from plus or minus 0 to 3 degrees relative to said dryer angle of declination.

4. The asphalt plant as set forth in claim 1, wherein said dryer angle of declination is selected from the range of 2.5 to 6.5 degrees and said mixer angle of declination is selected from the range of 1 to 8 degrees.

5. The asphalt plant as set forth in claim 4, wherein said dryer angle of declination is approximately 5 degrees and said mixer angle of declination is selected from the range of 1 to 6 degrees.

6. The asphalt plant as set forth in claim 1, said mixer cylinder being positioned concentrically with respect to said dryer cylinder such that said longitudinal mixer axis and said longitudinal dryer axis lie within a common vertical plane and said longitudinal mixer axis intersects said longitudinal dryer axis within a region defined by said internal passageway of said dryer cylinder and said internal passageway of said mixer cylinder.

7. The asphalt plant as set forth in claim 1, said mixer cylinder being positioned offset with respect to said dryer cylinder such that said longitudinal mixer axis and said longitudinal dryer axis are offset, and such that the cross sectional area of said second clindrical end of said dryer cylinder is contained within the cross sectional area of said mixer cylinder.

8. The asphalt plant as set forth in claim 1, including a recycle feeder mounted adjacent said second cylindrical end of said dryer cylinder and said first cylindrical end of said mixer cylinder to deliver recycle asphalt material to said first cylindrical end of said mixer cylinder.

9. The asphalt plant as set forth in claim 1, wherein said motorized dryer drive to rotate said dryer cylinder includes a variable speed dryer driver to adjustably vary the speed of rotation of said dryer cylinder to selectively control the residence time of material within said dryer cylinder.

10. The asphalt plant as set forth in claim 1, wherein said motorized mixer drive to rotate said mixer cylinder includes a variable speed mixer driver to adjustably vary the speed of rotation of said mixer cylinder to selectively control the residence time of material within said mixer cylinder.

11. The asphalt plant as set forth in claim 1, including a combustion tube connected to burner head and disposed within said internal passageway in said mixer cylinder to deliver combustion air and fuel to said burner head to generate said hot gas stream within said dryer cylinder and thereby prevent said hot gas stream from contacting material within said mixer cylinder.

12. The asphalt plant as set forth in claim 1, wherein said dryer cylinder has a plurality of lifting flights mounted on the interior surface thereof to tumble said aggregate material within the internal passageway of said dryer cylinder to facilitate the drying and heating of the aggregates as the dryer cylinder rotates.

13. The asphalt plant as set forth in claim 1, wherein said mixer cylinder has a plurality of mixing paddles mounted on the interior surface thereof to mix and blend the liquid asphalt with the aggregate to form the asphaltic composition within said mixer cylinder.

14. The asphalt plant as set forth in claim 1, including a feeder having a discharge end disposed within said mixer cylinder for introducing fine binder material for mixing with the liquid asphalt and aggregate materials to form the asphaltic composition within said mixer cylinder.

15. A method for continuously producing an asphaltic composition from asphalt and aggregates, the steps of said method comprising:

introducing aggregate material interiorly of a first, feed end of a declined, horizontal dryer cylinder having a second, cylindrical discharge end and having a central longitudinal dryer axis at a dryer angle of declination such that said first end is positioned slightly above said second cylindrical end;

rotating said dryer cylinder about the central longitudinal axis thereof to cause aggregate material therein to move from said first end to said second cylindrical end of said dryer cylinder;

generating a hot gas stream within said dryer cylinder adjacent the second cylindrical end thereof to flow through said dryer cylinder to said first end in countercurrent relation to the movement of said aggregate material to dry and heat said aggregate material;

discharging said aggregate material from said second cylindrical end of said dryer cylinder being fitted within a first, cylindrical feed end of a declined, horizontal mixer cylinder having a second, discharge end and having a central longitudinal mixer axis at a mixer angle of declination such that said first cylindrical end is positioned slightly above said second end;

isolating said mixer cylinder from said hot gas stream;

rotating said mixer cylinder about the central longitudinal axis thereof to cause material therein to move from said first cylindrical end to said second end of said mixer cylinder;

mixing said aggregate material with liquid asphalt within said mixer cylinder isolated from said hot gas stream to produce an asphaltic composition; and discharging said asphaltic composition from said second end of said mixer cylinder.

16. The method as set forth in claim 15, including the steps of declining said dryer cylinder at a dryer angle of declination selected from the range of 2.5 to 6.5 degrees and declining said mixer cylinder at a mixer angle of declination selected from the range of 1 to 8 degrees.

17. The method as set forth in claim 16, wherein said dryer angle of declination is approximately 5 degrees and said mixer angle of declination is selected from the range of 1 to 6 degrees.

18. The method as set forth in claim 15, including the step of adding recycle asphalt material directly to said first cylindrical end of said mixer cylinder isolated from said hot gas stream.

19. The method as set forth in claim 15, including the step of rotating said mixer cylinder at a speed different from the speed at which said dryer cylinder is rotated.

20. The method as set forth in claim 15, including the step of declining said mixer cylinder at a mixer angle of declination different from said dryer angle of declination of said dryer cylinder.

21. The method as set forth in claim 15, including the step of tumbling aggregate material within said dryer cylinder to facilitate the drying and heating of the aggregates by said hot gas stream as the dryer cylinder rotates.

22. The method as set forth in claim 15, including the step of blending a fine binder material with said liquid asphalt and aggregate material within said mixer cylinder.

23. An asphaltic composition produced by a process comprising the steps of:

introducing aggregate material interiorly of a first, feed end of a declined, horizontal dryer cylinder having a second, cylindrical discharge end and having a central longitudinal dryer axis at a dryer angle of declination such that said first end is positioned slightly above said second cylindrical end;

aggregate rotating said dryer cylinder about the central longitudinal axis thereof to cause material therein to move from said first end to said second cylindrical end of said dryer cylinder;

generating a hot gas stream within said dryer cylinder adjacent the second cylindrical end thereof to flow through said dryer cylinder to said first end in countercurrent relation to the movement of said aggregate material to dry and heat said aggregate material;

discharging said aggregate material from said second cylindrical end of said dryer cylinder being fitted within a first, cylindrical feed end of a declined, horizontal mixer cylinder having a second, discharge end and having a central longitudinal mixer axis at a mixer angle of declination such that said first cylindrical end is positioned slightly above said second end;

isolating said mixer cylinder from said hot gas stream;

rotating said mixer cylinder about the central longitudinal axis thereof to cause material therein to move from said first cylindrical end to said second end of said mixer cylinder;

mixing said aggregate material with liquid asphalt within said mixer cylinder isolated from said hot gas stream to produce an asphaltic composition; and discharging said asphaltic composition from said second end of said mixer cylinder.

24. The asphaltic composition as set forth in claim 23 produced by the process including the step of adding recycle asphalt material directly to said first cylindrical end of said mixer cylinder isolated from said hot gas stream.

25. The asphaltic composition as set forth in claim 23 produced by the process including the step of rotating said mixer cylinder at a speed different from the speed at which said dryer cylinder is rotated.

26. The asphaltic composition as set forth in claim 23 produced by the process including the step of declining said mixer cylinder at a mixer angle of declination different from said dryer angle of declination of said dryer cylinder.

* * * * *